US011611187B2

(12) United States Patent
Wiltraut et al.

(10) Patent No.: US 11,611,187 B2
(45) Date of Patent: Mar. 21, 2023

(54) CONTACT BENDING ASSEMBLY FOR ELECTRICAL CONNECTOR ASSEMBLING MACHINE

(71) Applicant: TE Connectivity Services GmbH, Schaffhausen (CH)

(72) Inventors: David Wiltraut, Middletown, PA (US); Scott Thomas Schlegel, Middletown, PA (US)

(73) Assignee: TE Connectivity Solutions GmbH

( * ) Notice: Subject to any disclaimer, the term of this patent is extended or adjusted under 35 U.S.C. 154(b) by 62 days.

(21) Appl. No.: 17/388,789

(22) Filed: Jul. 29, 2021

(65) Prior Publication Data

US 2023/0032253 A1 Feb. 2, 2023

(51) Int. Cl.

| | |
|---|---|
| ***H01R 43/16*** | (2006.01) |
| ***B21F 45/00*** | (2006.01) |
| ***B21F 1/00*** | (2006.01) |
| ***H01R 43/055*** | (2006.01) |

(52) U.S. Cl.

CPC ..... *H01R 43/16* (2013.01); *B21F 1/004* (2013.01); *B21F 45/00* (2013.01); *H01R 43/055* (2013.01)

(58) Field of Classification Search

CPC ..... H01R 43/00; H01R 43/04; H01R 43/16; H01R 43/055; Y10T 29/53209; Y10T 29/53261; B21F 1/004; B21F 45/00

USPC ..... 29/747

See application file for complete search history.

(56) References Cited

U.S. PATENT DOCUMENTS

| | | | | |
|---|---|---|---|---|
| 10,236,650 | B2 * | 3/2019 | Dai | H01R 43/04 |
| 10,658,807 | B2 * | 5/2020 | Dai | H01R 43/04 |
| 2013/0333211 | A1 * | 12/2013 | Lee | H01R 43/00 29/877 |

* cited by examiner

*Primary Examiner* — Donghai D Nguyen

(57) ABSTRACT

An electrical connector assembling machine includes a connector strip feed unit including a connector strip feeding device configured to index a connector strip through a feed track in successive feed strokes and a contact loading assembly to load contacts in the connector strip. The electrical connector assembling machine includes a contact bending assembly positioned downstream of the contact loading assembly. The contact bending assembly includes a roller and a bending actuator holding the roller. The bending actuator moves the roller in an actuation direction to engage and bend ends of the contacts. The roller rolling along the contacts to bend the ends of the contacts.

21 Claims, 9 Drawing Sheets

CONTACT BENDING ASSEMBLY FOR ELECTRICAL CONNECTOR ASSEMBLING MACHINE

BACKGROUND OF THE INVENTION

The subject matter herein relates generally to machines for manufacturing electrical connectors.

Machines are known for assembling electrical connectors. For example, some known machines are used to load contacts into a connector housing. Manufacture and assembly of individual connectors is time consuming and expensive. For example, individually loading the contacts into the connector housing is time consuming. Conventional machines are typically designed to manufacture one particular electrical connector arrangement. Changeover of the machine to manufacture a different type of electrical connector is time consuming and involves replacement of many components of the machine.

A need remains for a machine for efficiently and reliably manufacturing electrical connectors.

BRIEF DESCRIPTION OF THE INVENTION

In one embodiment, an electrical connector assembling machine for assembling an electrical connector is provided and includes a connector housing manufactured from a connector strip that is a continuous extruded dielectric material and contacts manufactured from continuous wires. The electrical connector assembling machine includes a connector strip feed unit including a connector strip feed track receiving the connector strip. The connector strip feed unit includes a connector strip feeding device configured to index the connector strip through the connector strip feed track in successive feed strokes. The electrical connector assembling machine includes a contact loading assembly adjacent the connector strip feed track to load contacts in the connector strip. The contact loading assembly includes a wire feed unit includes feed tracks receiving the wires. The wire feed unit includes a feeding device configured to simultaneously index the wires through the corresponding feed tracks in successive feed strokes. The contact loading assembly includes a contact forming unit receiving the wires from the wire feed unit. The contact forming unit having a wire cutter for separating the contacts from the wires. The contact loading assembly includes a contact loading device loading the contacts made from the wires into the connector strip as the connector strip is advanced through the electrical connector assembling machine. The electrical connector assembling machine includes a contact bending assembly positioned downstream of the contact loading assembly. The contact bending assembly includes a roller and a bending actuator holding the roller. The bending actuator moves the roller in an actuation direction to engage and bend ends of the contacts. The roller rolling along the contacts to bend the ends of the contacts.

In another embodiment, an electrical connector assembling machine for assembling an electrical connector is provided and includes a connector housing manufactured from a connector strip that is a continuous extruded dielectric material and contacts manufactured from continuous wires. The electrical connector assembling machine includes a connector strip feed unit including a connector strip feed track receiving the connector strip. The connector strip feed unit includes a connector strip feeding device configured to index the connector strip through the connector strip feed track in successive feed strokes. The electrical connector assembling machine includes a contact loading assembly adjacent the connector strip feed track to load contacts in the connector strip. The contact loading assembly includes a wire feed unit includes feed tracks receiving the wires. The wire feed unit includes a feeding device configured to simultaneously index the wires through the corresponding feed tracks in successive feed strokes. The contact loading assembly includes a contact forming unit receiving the wires from the wire feed unit. The contact forming unit having a wire cutter for separating the contacts from the wires. The contact loading assembly includes a contact loading device loading the contacts made from the wires into the connector strip as the connector strip is advanced through the electrical connector assembling machine. The electrical connector assembling machine includes a contact bending assembly positioned downstream of the contact loading assembly. The contact bending assembly includes bending unit for bending ends of the contacts. The bending unit includes a roller, a bending actuator holding the roller, and a cam device for moves the bending actuator and the roller relative to the connector strip in a lateral shifting direction. The bending actuator moves the roller to engage and bend the ends of the contacts. The roller rolling along the contacts to bend the ends of the contacts.

In a further embodiment, an electrical connector assembling machine for assembling an electrical connector is provided and includes a connector housing manufactured from a connector strip that is a continuous extruded dielectric material and contacts manufactured from continuous wires. The electrical connector assembling machine includes a connector strip feed unit including a connector strip feed track receiving the connector strip. The connector strip feed unit includes a connector strip feeding device configured to index the connector strip through the connector strip feed track in successive feed strokes. The electrical connector assembling machine includes a contact loading assembly adjacent the connector strip feed track to load contacts in the connector strip. The contact loading assembly includes a wire feed unit includes feed tracks receiving the wires. The wire feed unit includes a feeding device configured to simultaneously index the wires through the corresponding feed tracks in successive feed strokes. The contact loading assembly includes a contact forming unit receiving the wires from the wire feed unit. The contact forming unit having a wire cutter for separating the contacts from the wires. The contact loading assembly includes a contact loading device loading the contacts made from the wires into the connector strip as the connector strip is advanced through the electrical connector assembling machine. The electrical connector assembling machine includes a contact bending assembly positioned downstream of the contact loading assembly. The contact bending assembly includes a first bending unit for bending first ends of the contacts. The first bending unit includes a first roller and a first bending actuator holding the first roller. The first bending actuator moves the first roller to engage and bend the first ends of the contacts. The contact bending assembly includes a second bending unit for bending second ends of the contacts. The second bending unit includes a second roller and a second bending actuator holding the second roller. The second bending actuator moves the second roller to engage and bend the second ends of the contacts. wherein the first bending unit and the second bending unit are selectively operated to bend the corresponding first or second ends of the contacts.

DETAILED DESCRIPTION OF THE INVENTION

Figure 1:
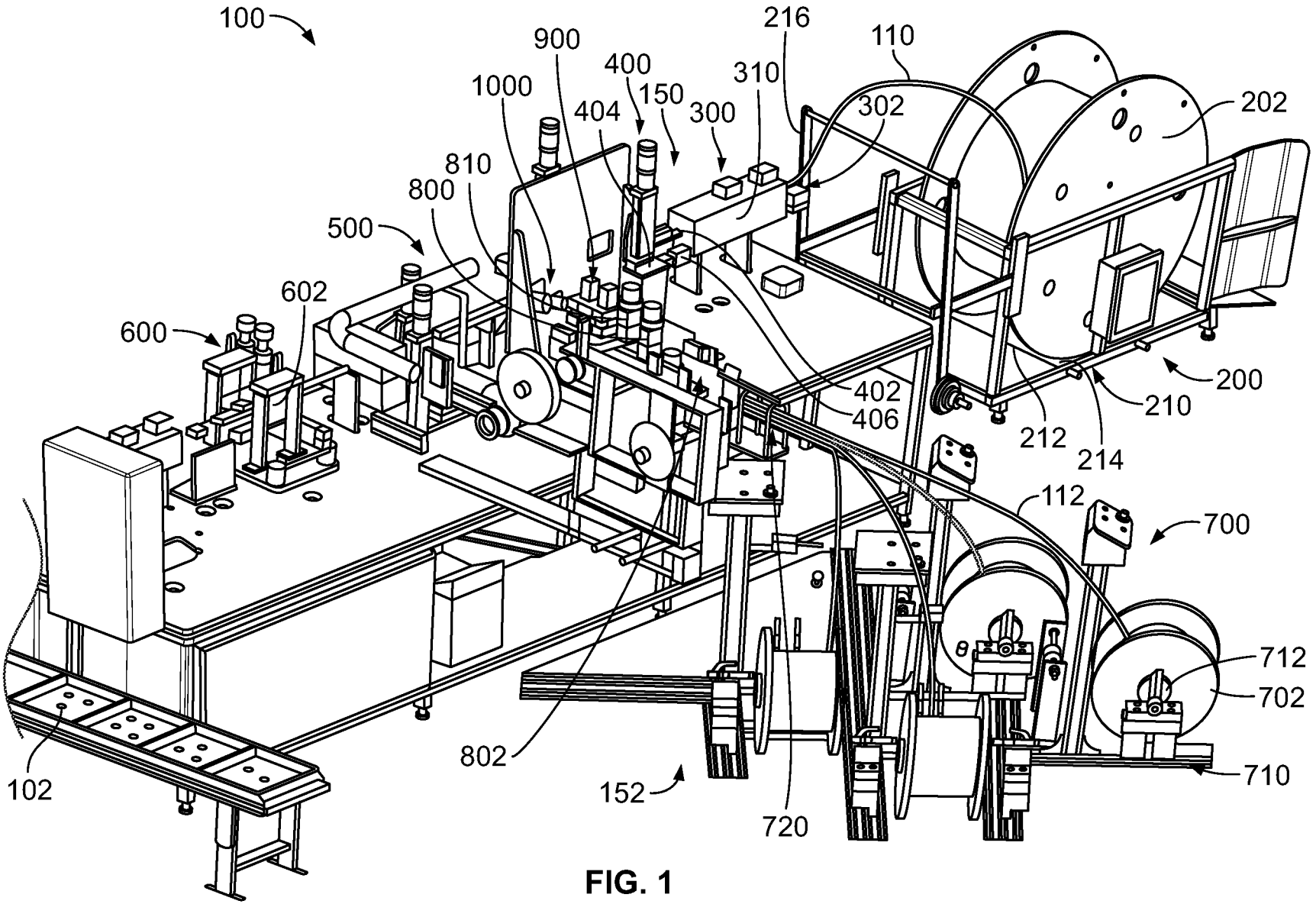
FIG. 1 illustrates an electrical connector assembling machine in accordance with an exemplary embodiment.

FIG. 1 illustrates an electrical connector assembling machine 100 in accordance with an exemplary embodiment. The electrical connector assembling machine 100 is used for assembling electrical connectors 102. For example, the electrical connector assembling machine 100 is used for forming connector housings 104 from a connector strip 110, which is a continuous extruded dielectric material connector strip. The electrical connector assembling machine 100 is used for forming contacts 106 manufactured from continuous wires 112. The electrical connector assembling machine 100 manufactures the electrical connectors 102 in a continuous, feed based manufacturing process, wherein formed electrical connectors 102 are separated from the continuous strip. The electrical connectors 102 may have various lengths to vary the number of positions or contacts within the electrical connector 102 for a particular application (for example, between 2 positions and 30 positions).

In an exemplary embodiment, the electrical connector assembling machine 100 is used for assembling mass termination assembly (MTA) electrical connectors, such as MTA 100 or MTA 156 connectors commercially available from TE Connectivity. For example, the electrical connector assembling machine 100 is used for assembling board mounted header connectors. The MTA 100 connectors have contacts in a single row on 0.100" (2.54 mm) centerline spacing between 2 and 28 positions. The MTA 156 connectors have contacts in a single row on 0.156" (3.96 mm) centerline spacing between 2 and 24 positions. The header connectors may be right angle connectors or vertical mount connectors. The header connectors may have latching features for latched coupling with the mating, receptacle connectors. The header connectors may have polarizing features, such as notches, for keyed mating with the receptacle connectors. The header connectors may have different colors (for example, MTA 100 vs MTA 156). The header connectors may have the contacts with different plating to offer solutions for a multitude of diverse applications.

The electrical connector assembling machine 100 includes a connector loading assembly 150 for supplying the connector housings 104 and a contact loading assembly 152 for supplying the contacts 106. The connector loading assembly 150 and the contact loading assembly 152 operate synchronously to manufacture the electrical connectors 102. The connector loading assembly 150 of the electrical connector assembling machine 100 includes a connector strip distribution unit 200, a connector strip feed unit 300 and a connector strip notching unit 400. The electrical connector assembling machine 100 includes a contact bending assembly 500 for bending ends of the contacts 106 in the connector strip 110, such as to form right angle contacts 106. The electrical connector assembling machine 100 may further include an electrical connector separating unit 600. The connector strip distribution unit 200 is used to distribute the connector strip 110 to the machine 100. The connector strip feed unit 300 is used to feed the connector strip 110 through the machine 100. The connector strip notching unit 400 is used to process the connector strip 110 during a manufacturing process. The contact loading assembly 152 is used to feed the wires 112 through the machine 100. The electrical connector separating unit 600 is used to separate the assembled electrical connectors 102 from the strip. The electrical connector assembling machine 100 may include additional units in alternative embodiments for performing additional manufacturing processes.

The connector strip distribution unit 200 includes a reel cradle 210 for holding a reel 202 of the connector strip 110. The connector strip distribution unit 200 is used to unwind the connector strip 110 from the reel 202. In an exemplary embodiment, the connector strip distribution unit 200 includes a roller 212 for rotating the reel 202 of the connector strip 110 to unwind the connector strip 110 from the reel 202. The roller 212 automatically unwinds the connector strip 110 from the reel 202, such as to provide a slack length of the connector strip 110, which may be easily feed through the machine 100 without pulling the connector strip 110 tight at the reel 202. The roller 212 may be a powered roller that is rotated by an electric motor to unwind the reel 202. The roller 212 unwinds the connector strip 110 independent of the connector strip feed unit 300. For example, the connector strip feed unit 300 does not need to pull the connector strip 110 off of the reel 202. Rather, the connector strip 110 may be fed from the slack length that is unwound from the reel 202 by the roller 212.

In an exemplary embodiment, the connector strip distribution unit 200 includes a roller actuator 214 operably coupled to the roller 212 to rotate the roller 212. The roller actuator 214 may be a motor or other device used to rotate the roller 212, which in turn rotates the reel 202 to unwind the connector strip 110 from the reel 202. In an exemplary embodiment, the connector strip distribution unit 200 includes a roller trigger 216 operably coupled to the roller actuator 214 to activate the roller actuator 214 and cause the roller actuator 214 to rotate the roller 212.

In an exemplary embodiment, the connector strip feed unit 300 includes a feed track 302 receiving and guiding the connector strip 110 through the machine 100. The connector strip feed unit 300 includes a feeding device 310 configured to index the connector strip 110 through the feed track 302 in successive feed strokes. For example, the feeding device 310 may feed a defined length of the connector strip 110 for each feed stroke. In an exemplary embodiment, the feeding device 310 feeds the same length of connector strip 110 for each feed stroke. In various embodiments, the feeding device 310 may feed a length of the connector strip 110 corresponding to four contact positions or a four position connector length. For example, the feeding device 310 may feed 0.400" (10.16 mm) (for example, when manufacturing MTA 100 connectors) or 0.624" (15.84 mm) (for example, when manufacturing MTA 156 connectors).

In an exemplary embodiment, the connector strip notching unit 400 including a notching device 402 configured to cut notches in the connector strip 110 at designated locations. For example, the notches may be provided at ends of the connector housings 104 formed from the connector strip 110. The locations of the notches may be varied depending on the length of the connector housings 104 (for example, based on the number of contact positions of the electrical connector 102 being manufactured). In an exemplary embodiment, the notching device 402 includes a plurality of cutters 404 for selectively cutting through the dielectric material of the connector strip 110. The connector strip notching unit 400 includes a notching unit controller 406 operably coupled to the plurality of cutters 404 to selectively operate or actuate the cutters 404 as the connector strip 110 is indexed through the machine 100.

In an exemplary embodiment, the contact loading assembly 152 loads the contacts 106 into the connector strip 110 as the connector strip 110 is advanced through the electrical connector assembling machine 100. The contact loading assembly 152 may be used to simultaneously load multiple contacts 106 into the connector strip 110. For example, the connector strip 110 may remain at a fixed location for a period of time, during which the multiple contacts 106 are loaded into the connector strip 110, and then the connector strip 110 may be advanced during a feed stroke where another set of the contacts 106 may again be loaded into the connector strip 110. In various embodiments, four contacts 106 may be loaded into corresponding positions in the connector strip 110 during each feed stroke.

In an exemplary embodiment, the contact loading assembly 152 includes a wire distribution unit 700, a wire feed unit 800, a contact forming unit 900, and a contact loading device 1000. The wire distribution unit 700 is used to distribute the one or more of the wires 112 to the machine 100. In an exemplary embodiment, multiple wires 112 are simultaneously used to form contacts. For example, four different wires may be used for forming four contacts, which are simultaneously loaded into the connector strip 110. The wire feed unit 800 is used to feed the wires 112 through the machine 100. The contact forming unit 900 is used to process the wires 112 to form separate contacts 106 from the wires 112 during a manufacturing process. The contact loading device 1000 is used to load the contacts 106 into the connector strip 110. The electrical connector assembling machine 100 may include additional units in alternative embodiments for performing additional manufacturing processes.

The wire distribution unit 700 includes reel cradles 710 for holding reels 702 of the wire 112. The wire distribution unit 700 is used to unwind the wires 112 from the reels 702. In an exemplary embodiment, the wire distribution unit 700 includes rollers 712 for rotating the reels 702 of the wire 112 to unwind the wire 112 from the reels 702. The rollers 712 automatically unwind the wires 112 from the reels 702. The rollers 712 may be rotated by an electric motor to unwind the reels 702. In an exemplary embodiment, the wire distribution unit 700 includes a manifold 720 used to gather the wires 112. The manifold 720 combines the wires 112 in a consolidated area to direct the wires 112 into the wire feed unit 800.

The wire feed unit 800 includes a feed track 802 receiving and guiding the wire 112 through the machine 100. The wire feed unit 800 includes a feeding device 810 configured to index the wires 112 through the feed track 802 in successive feed strokes. For example, the feeding device 810 may feed defined lengths of the wires 112 for each feed stroke. In an exemplary embodiment, the feeding device 810 feeds the same length of wire 112 for each feed stroke. In various embodiments, the feeding device 810 may feed four of the wires 112 through the wire feed unit 800, which are processed by the contact forming unit 900 to make four contacts 106 at a time from the four wires 112. In an exemplary embodiment, the feeding device 810 is programmable to feed different lengths of the wires 112 depending on the particular application and requirements for the electrical connector 102.

The contact bending assembly 500 is located downstream of the contact loading assembly 152. The contact bending assembly 500 bends the contacts 106 into a predetermined shape, such as having a right angle bend. The contact bending assembly 500 may be selectively used. For example, the contact bending assembly 500 may be used in some situations to bend the contacts 106 but not used in other situations to leave the contacts 106 straight. Optionally, the contact bending assembly 500 may have multiple bending devices that bend the contacts in different directions. For example, one device may be used to bend the contacts 106 upward whereas another device may be used to bend the contacts 106 downward. In various embodiments, one device may be used to bend front ends of the contacts 106 whereas another device may be used to bend rear ends of the contacts 106. As such, the electrical connector assembling machine 100 may be used to manufacture various types of electrical connectors 102 using the same machine components.

In an exemplary embodiment, the electrical connector separating unit 600 is located downstream of the contact loading assembly 152 and the contact bending assembly 500. The electrical connector separating unit 600 includes a cutting device 602 for separating the electrical connectors 102, with the contacts 106 in the connector housing 104, from the connector strip 110 as the connector strip 110 is advanced through the electrical connector assembling machine 100. After the contacts 106 are loaded into the connector strip 110, the loaded connector housings 104 are separated from the connector strip 110 to form the electrical connector 102. The length of the connector housings 104 may be varied to vary the number of contacts 106 included in the electrical connector 102. For example, the machine 100 may manufacture short electrical connectors (for example, 2 or 4 position connectors), medium electrical connectors (for example, 10 or 15 position electrical connectors) or long electrical connectors (for example, 20 or 28 position electrical connectors). The machine may be used to make any reasonable length electrical connectors (for example, greater than 28 positions). The electrical connector separating unit 600 includes a cutting device 602 for separating the electrical connectors 102 from the connector strip 110.

Figure 2:
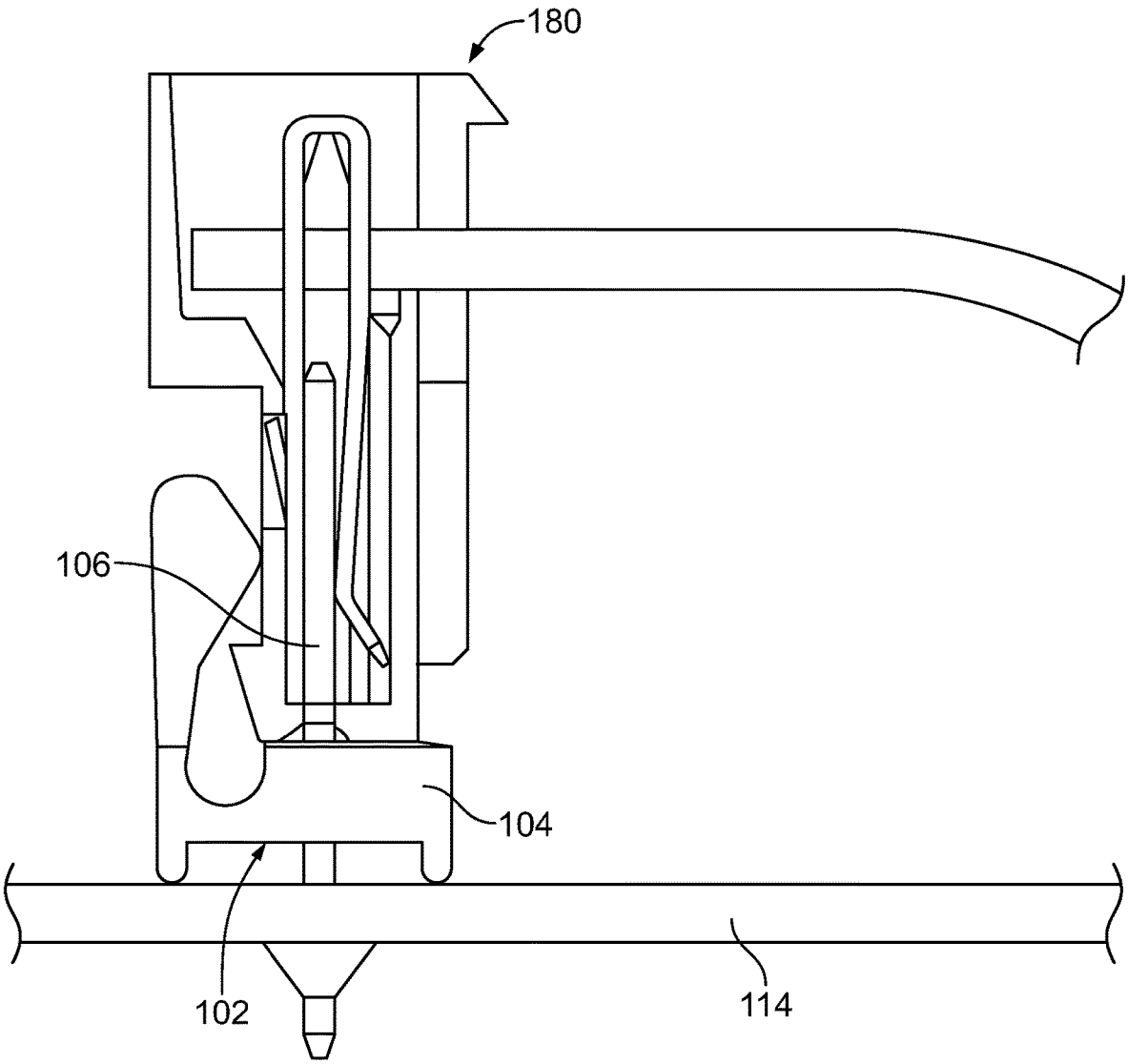
FIG. 2 is a cross sectional view of the electrical connector manufactured by the electrical connector assembling machine (FIG. 1) in accordance with an exemplary embodiment.

FIG. 2 is a cross sectional view of the electrical connector 102 manufactured by the electrical connector assembling machine 100 (FIG. 1) in accordance with an exemplary embodiment. The electrical connector 102 includes the connector housing 104 and the contact(s) 106 received in the connector housing 104. Any number of the contacts 106 may be received in the connector housing 104 (for example, between 2 and 28 contacts). The electrical connector 102 is a header connector mounted to a printed circuit board 114. The contacts 106 may be soldered to the printed circuit board 114.

A receptacle connector 180 is shown coupled to the electrical connector 102. The electrical connector 102 is a vertical connector mated with the receptacle connector 180 in a vertical direction (for example, downward) in a direction perpendicular to the printed circuit board 114. In alternative embodiments, the electrical connector 102 may be a right angle header connector configured to be mated with the receptacle connector 180 in a mating direction parallel to the printed circuit board 114.

Figure 3:
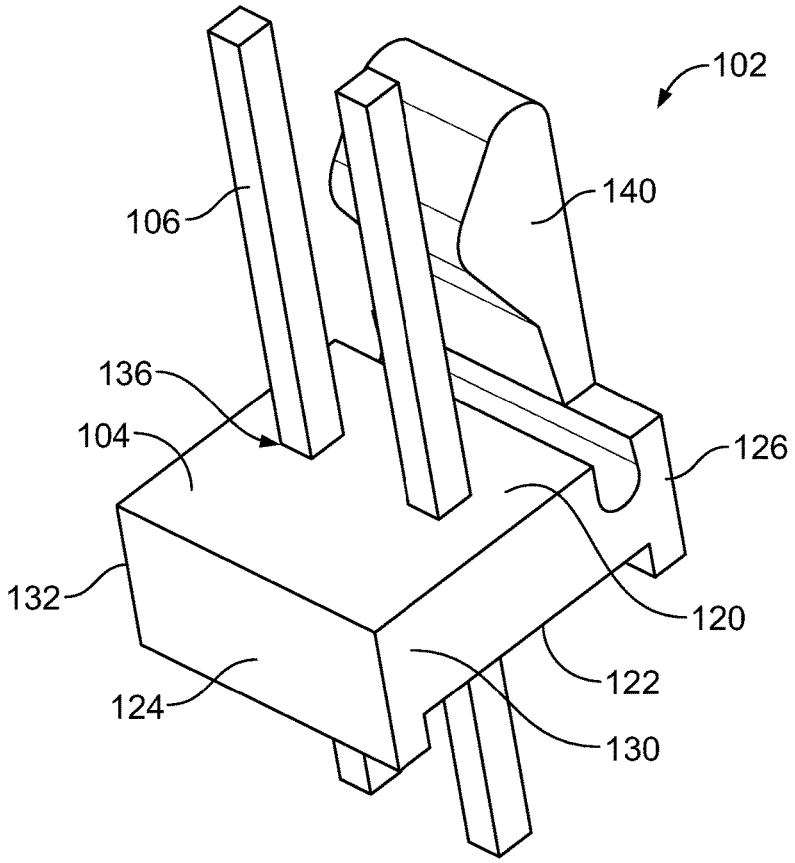
FIG. 3 is a perspective view of the electrical connector in accordance with an exemplary embodiment.

FIG. 3 is a perspective view of the electrical connector 102 in accordance with an exemplary embodiment. The electrical connector 102 is manufactured by the electrical connector assembling machine 100 (FIG. 1). For example, the electrical connector assembling machine 100 is used to manufacture the contacts 106 from the wires 112 and load the contacts 106 into the continuous strip of material defining the connector housing 104. The connector housings 104 with the contacts 106 therein are then separated from the continuous strip to form the electrical connectors 102. FIG. 3 shows the electrical connector 102 as a two position electrical connector; however, the electrical connectors 102 may be made in various lengths to vary the number of contacts 106 in the electrical connector 102 (for example, any length between 2 positions and 28 positions).

The connector housing 104 is made from the connector strip 110 (shown in FIG. 1), which is a continuous extruded dielectric material that is formed into a predetermined shape, such as an L-shape. The connector housing 104 includes a front 120 and a rear 122 opposite the front 120. During assembly, the contacts 106 are loaded into the connector strip through the rear 122. The connector housing 104 includes a first end 124 and a second end 126 opposite the first end 124. The connector housing 104 includes a first side 130 and a second side 132 opposite the first side 130. The sides 130, 132 are cut sides formed by cutting the connector housing 104 from the connector strip 110.

In an exemplary embodiment, the connector housing 104 includes contact openings 136 therethrough that receive corresponding contacts 106. The contact openings 136 may be preformed (for example, cut or drilled) through the main body of the connector housing 104. Alternatively, the contacts 106 may be pressed through the main body of the connector housing 104 during assembly to form the contact openings 136.

In an exemplary embodiment, the connector housing 104 includes a finger 140 extending from the front 120 of the main body. In the illustrated embodiment, the finger 140 is located at the second end 126. The finger 140 is a friction lock finger in various embodiments used for securing the receptacle connector 180 (shown in FIG. 2) to the electrical connector 102. In alternative embodiments, the connector housing 104 may be manufactured without the finger 140. For example, the connector strip 110 may be extruded without the finger 140.

Each contact 106 extends between a first end or front end 160 and a second end or rear end 162. The contact 106 includes an intermediate section 164 between the front end 160 and the rear end 162. The intermediate section 164 is received in the connector housing 104. In an exemplary embodiment, the contact 106 has a square cross-section. In the illustrated embodiment, the contact 106 is straight between the front end 160 and the rear end 162. However, the intermediate section 164 of the contact 106 may be bent to form right angle contacts. For example, the contact 106 may be bent such that the front end 160 is bent (for example, upward or downward) or the contact 106 may be bent such that the rear end 162 is bent (for example, upward or downward).

Figure 4:
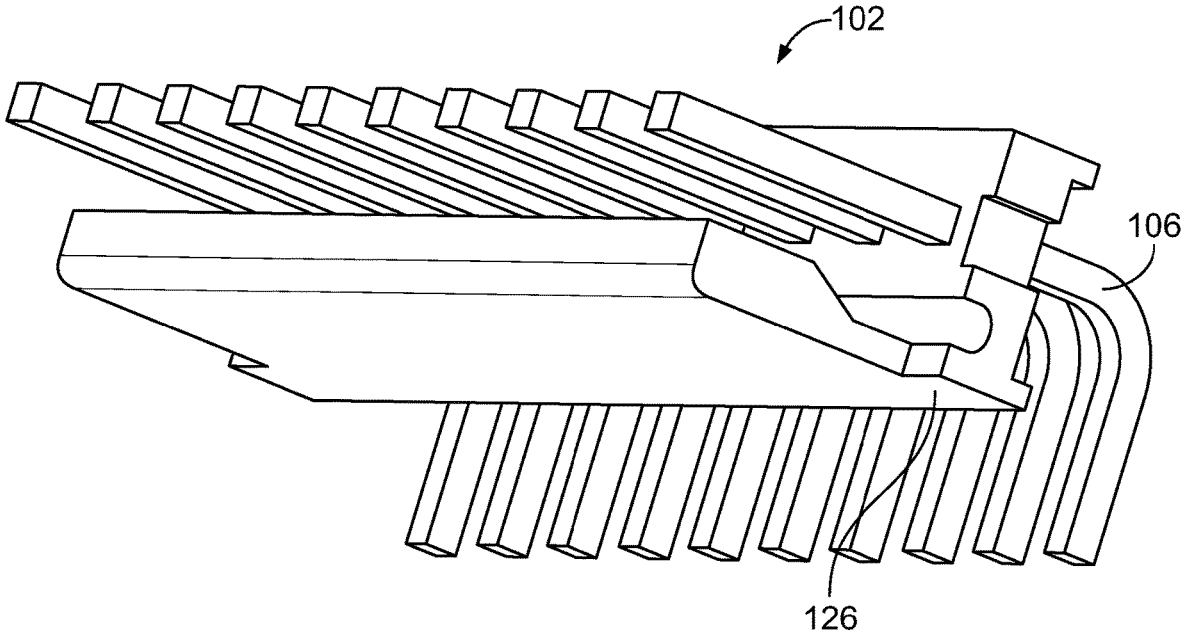
FIG. 4 is a perspective view of the electrical connector in accordance with an exemplary embodiment.

FIG. 4 is a perspective view of the electrical connector 102 in accordance with an exemplary embodiment. In the illustrated embodiment, the electrical connector 102 is a right-angle header connector. The contacts 106 are bent to include a right-angle bend. In such embodiment, the second end 126 is configured to be mounted to the printed circuit board 114 (shown in FIG. 2).

Figure 5:
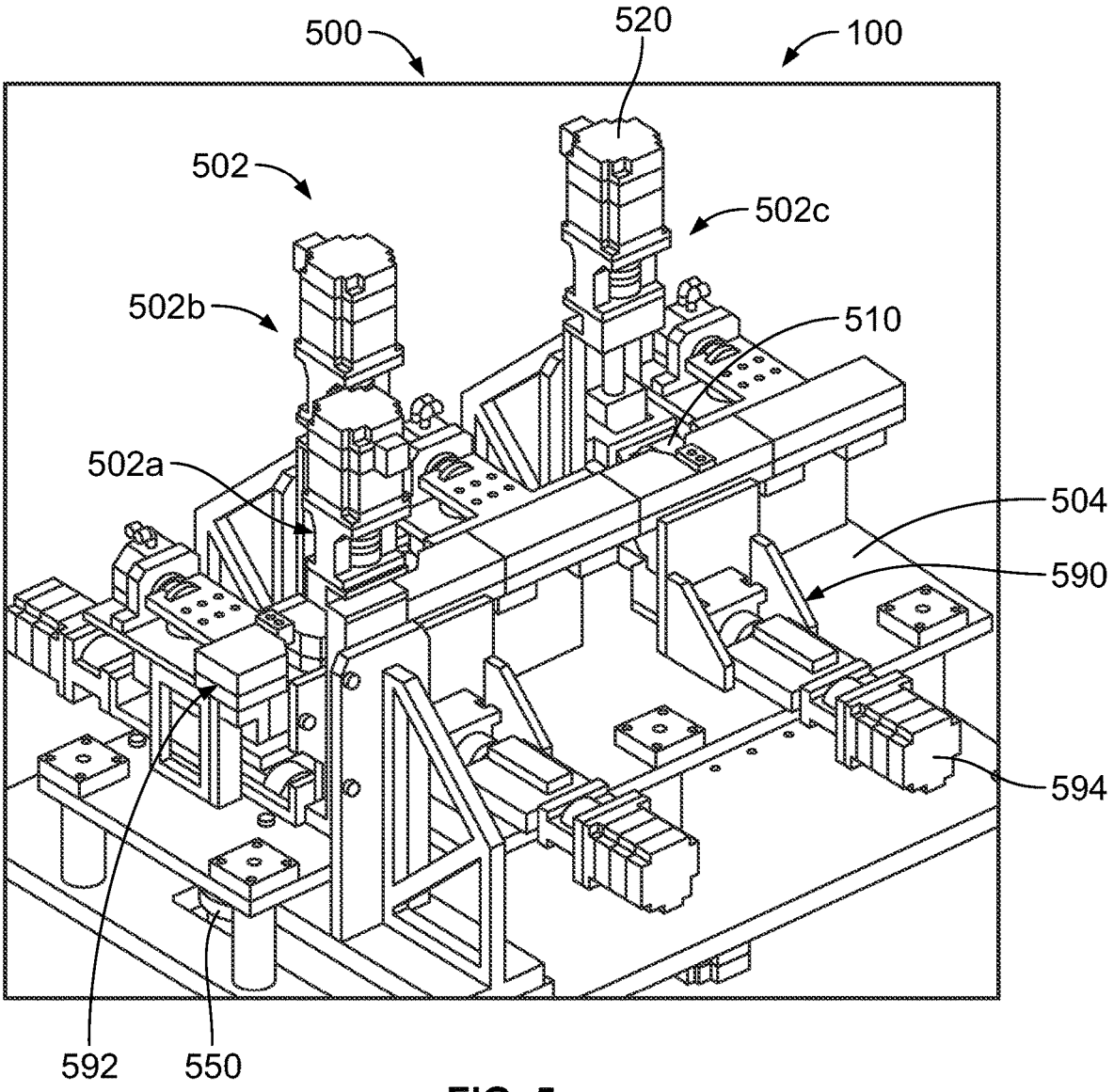
FIG. 5 is a perspective view of the contact bending assembly in accordance with an exemplary embodiment.
Figure 6:
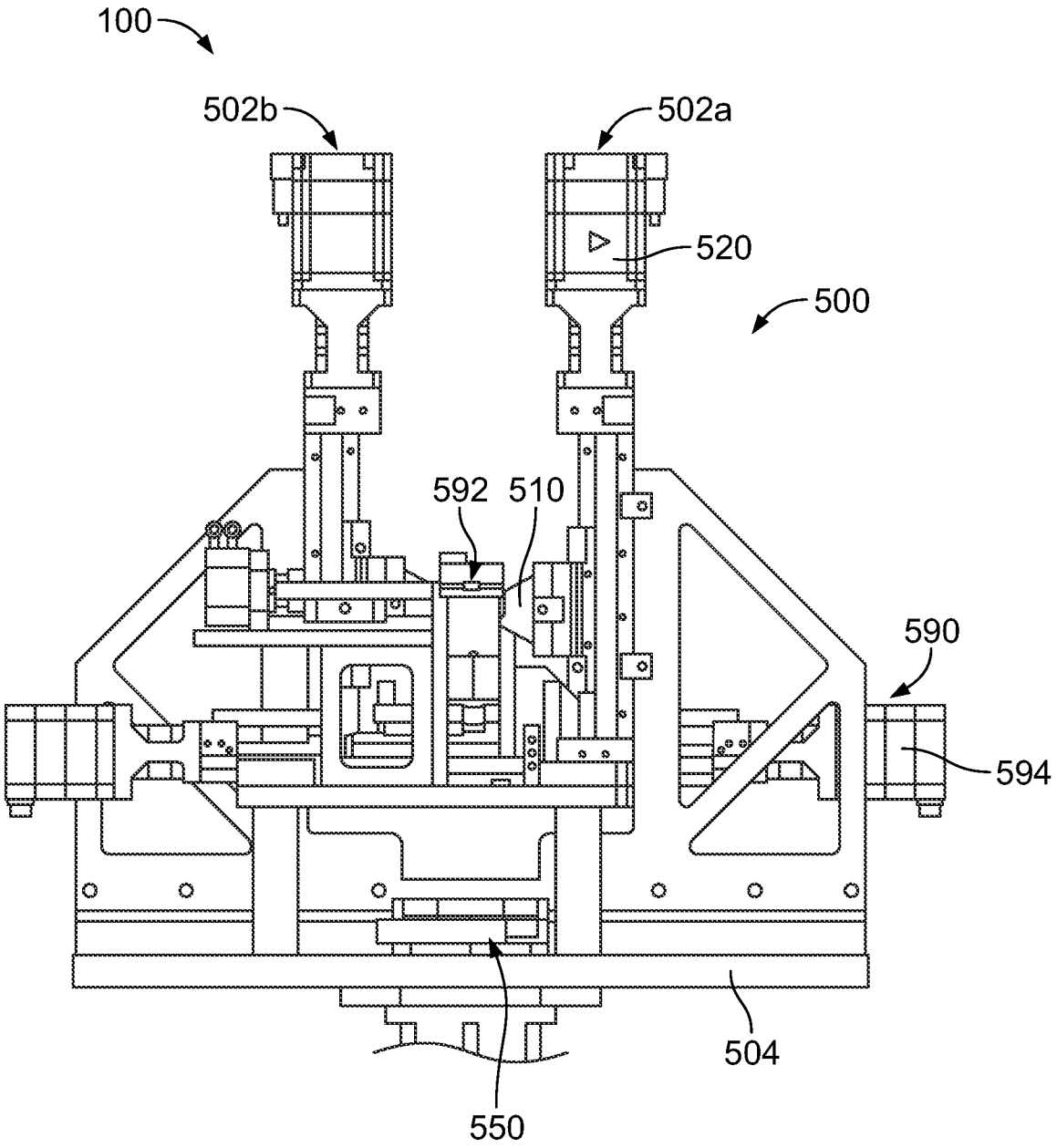
FIG. 6 is a side view of the contact bending assembly in accordance with an exemplary embodiment.

FIG. 5 is a perspective view of the contact bending assembly 500 in accordance with an exemplary embodiment. FIG. 6 is a side view of the contact bending assembly 500 in accordance with an exemplary embodiment. The contact bending assembly 500 includes one or more bending units 502 coupled to a frame 504 of the electrical connector assembling machine 100. The bending unit(s) 502 are used to bend the ends of the contacts 106. The various bending units 502 are used to bend the ends of the contacts 106 in different directions. The various bending units 502 may be used to bend different portions of the contacts 106 (for example, front ends 160 versus rear ends 162). In the illustrated embodiment, three bending units 502 are provided including a first bending unit 502*a* for bending the front ends 160 of the contacts 106 upward, a second bending unit 502*b* for bending the rear ends 162 of the contacts 106 upward; and a third bending unit 502*c* for bending the rear ends 162 of the contacts 106 downward. Other bending units may be provided, such as for bending the front ends 160 of the contacts 106 downward.

Each bending unit 502 includes a roller 510, a bending actuator 520 and a lateral actuator 550. The roller 510 is used to bend the contacts 106. The roller rolls along the contacts 106 to bend the contacts 106 rather than wiping or sliding along the contacts, which could scrape or damage the contacts 106. The bending actuator 520 holds the roller 510. The bending actuator 520 is used to move the roller 510 in an actuation direction, such as between a retracted position and an advanced position. For example, the bending actuator 520 may move the roller 510 in a vertical direction. The lateral actuator 550 is used to move the roller 510 in a lateral direction perpendicular to the actuation direction. For example, the lateral actuator 550 may move the roller 510 in a horizontal direction. Optionally, the lateral actuator 550 may move the bending actuator 520 to move the roller in the lateral direction. The lateral actuator 550 is used to overbend the contacts 106 during the bending process to account for spring back of the contacts 106. For example, the lateral actuator 550 causes the roller to shift laterally (for example, horizontally) while rolling along the contacts 106 in the actuation direction (for example, vertically). In an alternative embodiment, the lateral actuator 550 may be coupled to the feed track holding the connector strip 110 and the contacts 106 to shift the connector strip 110 and the contacts 106 relative to the roller 510 in a lateral shifting direction rather than shifting the roller relative to the contacts 106.

In an exemplary embodiment, the contact bending assembly 500 includes a connector strip positioner 590. The connector strip positioner 590 includes a feed track 592 holding the connector strip 110 with the contacts 106 loaded therein. The connector strip 110 is indexed through the feed track 592 in a longitudinal direction. The feed track 592 position the connector strip 110 both horizontally and vertically (for example, both perpendicular to the longitudinal direction). The connector strip positioner 590 includes one or more position actuators 594 for controlling a lateral position of the feed track 592. The position actuators 594 may laterally position the connector strip 110 relative to the bending units 502, such as to accommodate different sized or shaped connector strips 110 and/or contacts 106. Each position actuator 594 may be an electric actuator including a motor, a ball screw driven by the motor, and a carriage moved by the ball screw. For example, the motor may be a servo motor. Other types of actuators may be used in alternative embodiments.

Figure 7:
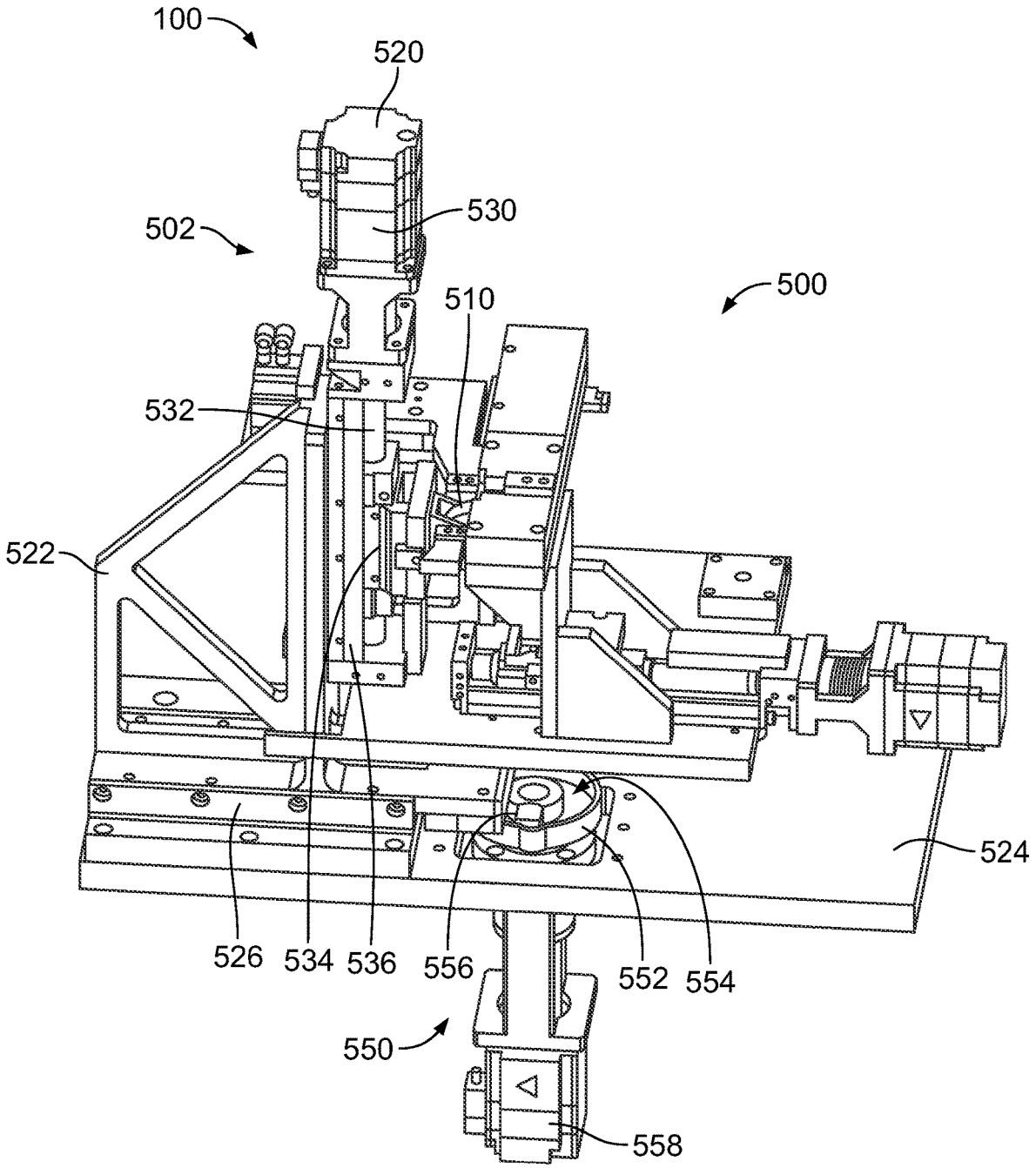
FIG. 7 is a perspective view of a portion of the contact bending assembly in accordance with an exemplary embodiment.

FIG. 7 is a perspective view of a portion of the contact bending assembly 500 in accordance with an exemplary embodiment. FIG. 7 shows one of the bending units 502. The bending unit 502 includes the roller 510 and the bending actuator 520 for moving the roller 510 in an actuation direction (for example, a vertical actuation direction. The roller 510 rolls along the contacts 106 to bend the contacts 106 as the roller is moved in the actuation direction. The bending unit 502 includes the lateral actuator 550 for moving the bending actuator 520 and the roller 510 in the lateral shifting direction (for example, a horizontal shifting direction).

The bending actuator 520 is mounted to a bracket 522 on a support plate 524, which may be part of the frame of the electrical connector assembling machine 100. In an exemplary embodiment, the bracket 522 is mounted to a slide 526 to allow lateral movement of the bracket 522 relative to the support plate 524.

The bending actuator 520 includes a motor 530, a ball screw 532 driven by the motor 530, and a carriage 534 operably coupled to the ball screw 532. The roller 510 is mounted to the carriage 534, such as being bolted or otherwise fastened or secured to the carriage 534. The carriage 534 is slidable along a feed rail 536 mounted to the bracket 522. The feed rail 536 controls the feed direction of the carriage 534. For example, the feed rail 536 may be oriented vertically to allow vertical movement of the carriage 534, and thus the roller 510. The roller 510 is carried by the carriage 534 and is movable with the carriage 534 as the carriage 534 slides along the feed rail 536 both in a forward advancing direction and in a rearward retracting direction. In various embodiments, the advancing direction may be an upward direction to bend the contacts 106 upward. In other various embodiments, the advancing direction may be a downward direction to bend the contacts downward.

In operation, the motor 530 is operated to drive the ball screw 532 and move the carriage 534 in a forward direction and a reverse direction to move the roller 510 between a retracted position and an advanced position. The motor 530 has controlled movement and positioning for repeatable and known positioning of the roller 510. The motor 530 may be programmable to control functions, such as the roll distance, the roll speed, the roll direction, and the like. For example, the motor 530 may be a servo motor having computer controlled forward and reverse operation. Other types of drive mechanisms may be used in alternative embodiments.

The lateral actuator 550 is coupled to the support plate 524. The lateral actuator 550 includes a cam device 552 used to move the roller 510 in the lateral direction. In the illustrated embodiment, the cam device 552 is operably coupled to the slide 526. The cam device 552 is rotated to move the slide 526 in the lateral shifting direction. The slide 526 moves the bracket 522, and thus the bending actuator 520 and the roller 510 in the lateral shifting direction. For example, a drive pin or other component of the slide 526 may be received in a pocket 554 of the cam device 552. The cam device 552 includes a cam surface 556 extending into the pocket 554. The drive pin rides along the cam surface 556 as the cam device 552 is rotated to shift the slide 526 in the lateral shifting direction. A cam actuator 558 is operably coupled to the cam device 552. The cam actuator 558 may be an electric motor used to rotate the cam device 552. Other types of actuation devices may be used in alternative embodiments. For example, a ram or other linear actuation device may be used rather than the cam device.

Figure 8:
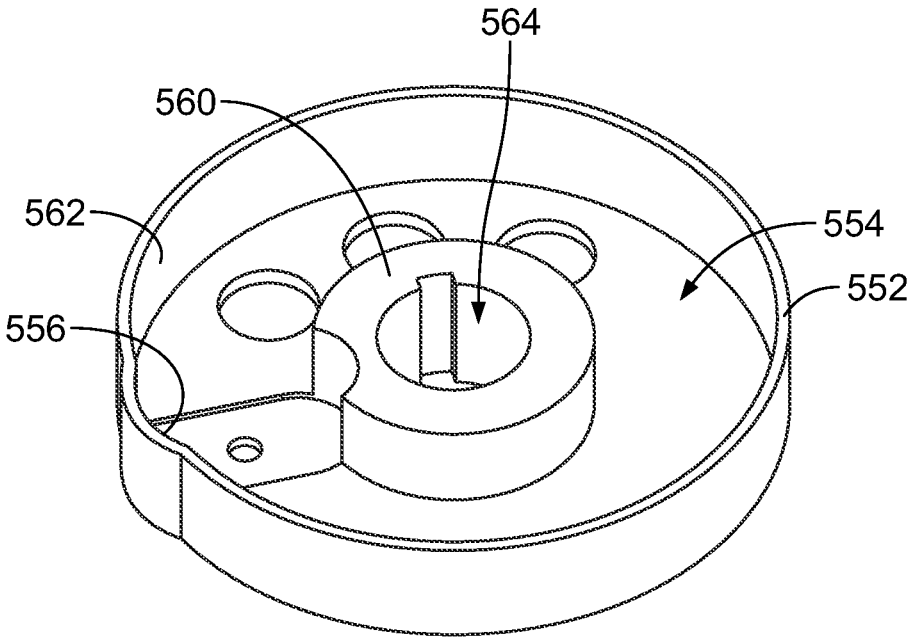
FIG. 8 is a perspective view of the cam device of the contact bending assembly in accordance with an exemplary embodiment.

FIG. 8 is a perspective view of the cam device 552 of the contact bending assembly 500 in accordance with an exemplary embodiment. The cam device 552 is disk shaped having a central hub 560 and an outer wall 562. The pocket 554 is defined between the hub 560 and the outer wall 562. The hub 560 includes an opening 564 that receives a drive shaft of the cam actuator 558 (shown in FIG. 7). The cam device 552 is rotated about an axis extending through the opening 564. In an exemplary embodiment, the outer wall 562 includes the cam surface 556. For example, the outer wall 562 is shaped to form the cam surface 556. In the illustrated embodiment, the cam surface 556 extends inwardly into the pocket 554. A drive pin of the slide 526 (shown in FIG. 7) is configured to be received in the pocket 554 and configured to ride along the cam surface 556 as the cam device 552 is rotated. The cam surface 556 causes the drive pin to move radially inward, which causes the slide 526 to shift in the lateral direction to move the roller 510.

Figure 9:
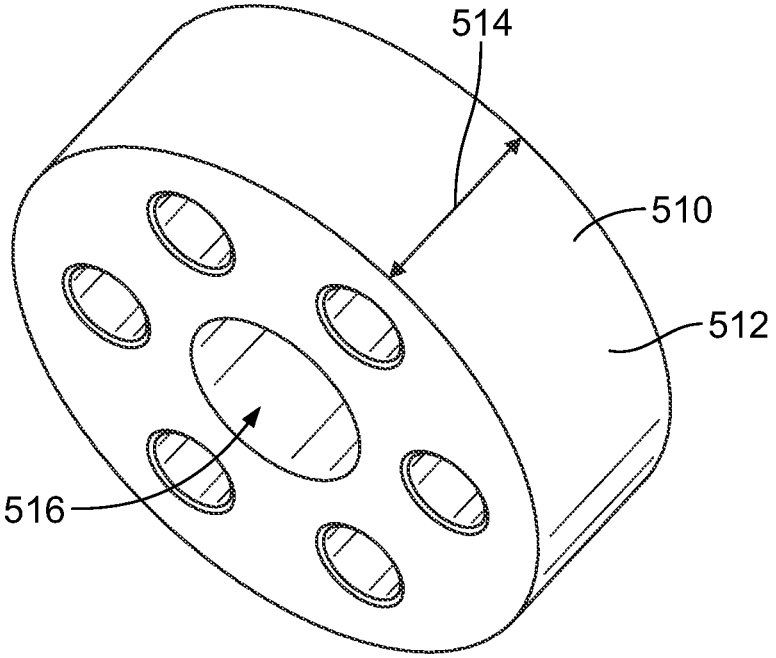
FIG. 9 is a perspective view of the roller of the contact bending assembly in accordance with an exemplary embodiment.

FIG. 9 is a perspective view of the roller 510 of the contact bending assembly 500 in accordance with an exemplary embodiment. The roller 510 is disk shaped having a circular cross-section. The roller 510 includes an outer surface 512 having a curved profile. The outer surface 512 is configured to engage and roll along the contacts 106 during use to bend the contacts 106. The roller 510 has a width 514 between opposite sides of the roller 510. The width 514 corresponds to a contact pitch of the contacts 106 for the particular electrical connector (for example, 0.100" (2.54 mm) pitch or 0.156" (3.96 mm) pitch) to bend a predetermined number of the contacts 106 simultaneously. For example, the roller 510 may have a width corresponding to four contacts 106 to bend four contacts at a time. Other widths are possible in alternative embodiments to bend greater or fewer contacts 106. The roller 510 includes a central opening 516 configured to receive an axle. The roller 510 rotates on the axle. In alternative embodiments, the roller 510 may include an axle extending from the sides of the roller 510 rather than the opening 516.

Figure 10:
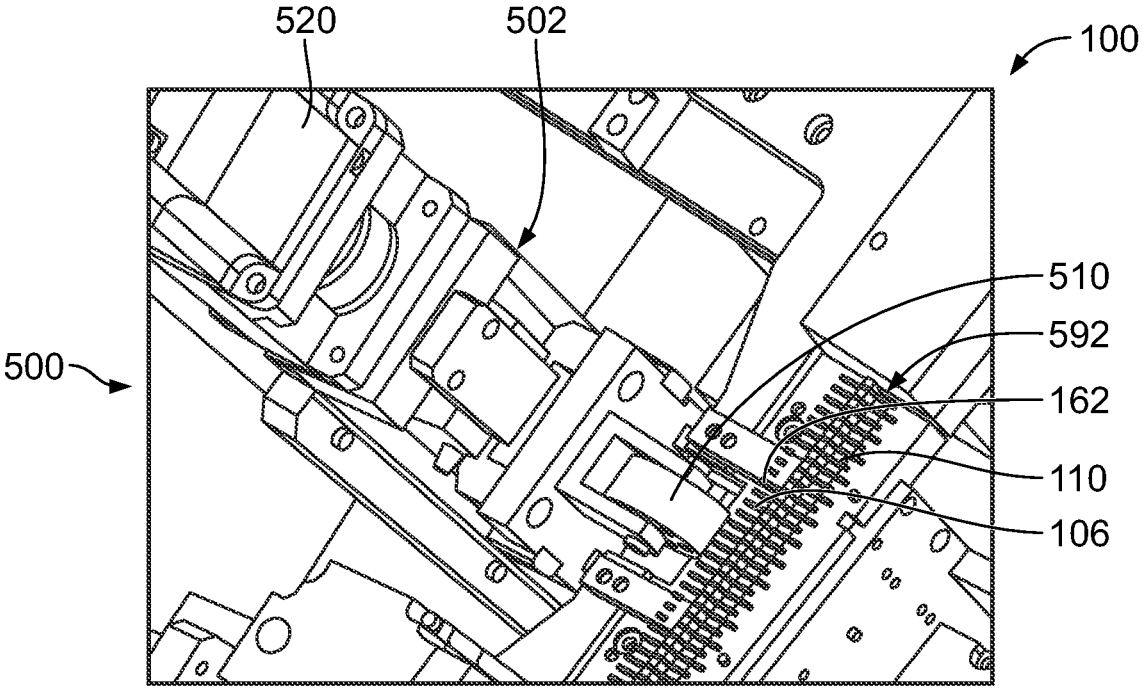
FIG. 10 is a perspective view of a portion of the contact bending assembly in accordance with an exemplary embodiment having some components removed to illustrate internal components of the contact bending assembly.

FIG. 10 is a perspective view of a portion of the contact bending assembly 500 in accordance with an exemplary embodiment having some components removed to illustrate internal components of the contact bending assembly 500. The roller 510 of the contact bending unit 502 is shown in FIG. 10 relative to the contacts 106. In the illustrated embodiment, the roller 510 is used to bend the rear ends 162 of the contacts 106 upward.

During operation of the electrical connector assembling machine 100, the connector strip 110 with the contacts 106 loaded therein are fed to the contact bending assembly 500. The connector strip 110 is indexed through the feed track 592 in a longitudinal direction through successive feed strokes. In an exemplary embodiment, each feed stroke moves the connector strip 110 by four contact positions.

When the connector strip is stationary, the contact bending assembly 500 is operated. The roller 510 is advanced by the bending actuator 520 to engage the contacts 106 and bend the ends of the corresponding contacts 106. The roller 510 rolls along the contacts 106 as the roller is advanced by the bending actuator 520 rather than wiping or sliding along the contacts, which could scrape or damage the contacts 106.

Figure 11:
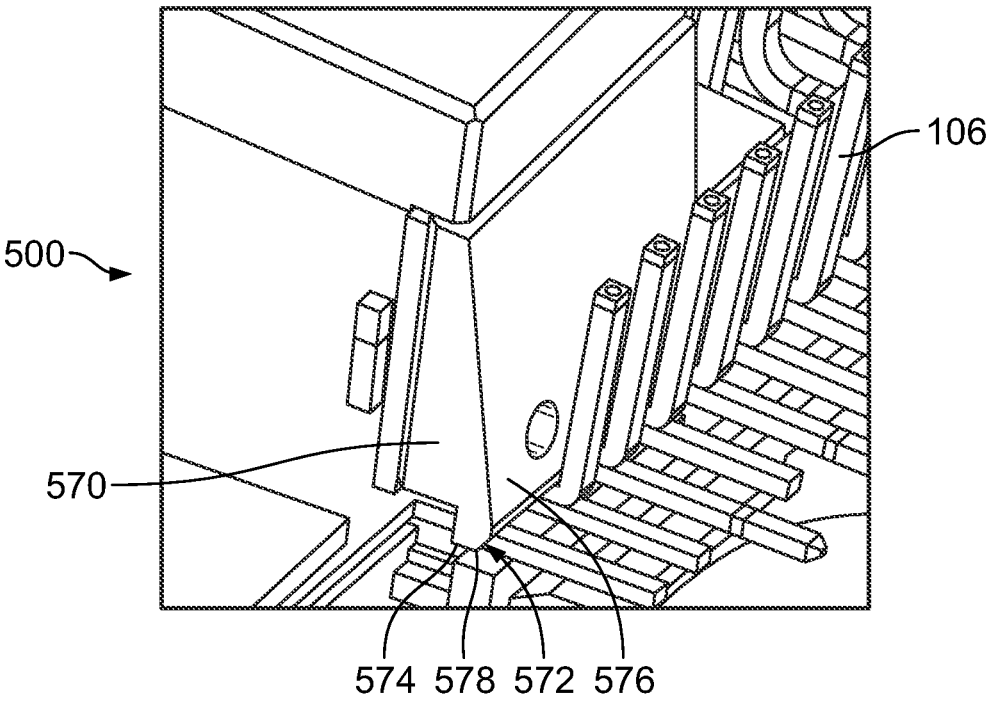
FIG. 11 is a perspective view of a portion of the contact bending assembly in accordance with an exemplary embodiment having some components removed to illustrate internal components of the contact bending assembly.

FIG. 11 is a perspective view of a portion of the contact bending assembly 500 in accordance with an exemplary embodiment having some components removed to illustrate internal components of the contact bending assembly 500. In an exemplary embodiment, the contact bending assembly 500 includes a forming anvil 570 having a bending profile 572. The forming anvil 570 is used with the roller 510 (shown in FIG. 10) to form the contacts 106. The contacts 106 are configured to be bent around the bending profile of the forming anvil 570. In an exemplary embodiment, the forming anvil 570 is removable and replaceable to change the bending profile, such as to change the radius of curvature of the bend.

The forming anvil 570 includes a base 574, a recessed surface 576 and a bending edge 578 between the base 574 and the recessed surface 576. The bending profile 572 is defined by the outer surfaces of the base 574, the bending edge 578, and the recessed surface 576. The base 574 may be positioned immediately adjacent the contacts 106. The portion of the contact 106 extending beyond the base 574 is bent around the bending edge 578. In various embodiments, the forming anvil 570 is located above the contacts 106 and the contacts 106 are bent upward around the bending edge 578. In other various embodiments, the forming anvil 570 is located below the contacts 106 and the contacts 106 are bent downward around the bending edge 578.

In an exemplary embodiment, the recessed surface 576 is angled away from the bending edge 578 to form a space or region for overbending the ends of the contacts 106. For example, the contacts undergo both plastic deformation and elastic deformation during the bending process. The contacts 106 have some spring back when the roller 510 is released from the contacts 106 due to the elastic deformation. As such, to achieve a right angle bend, the ends of the contacts are subject to overbending, beyond 90°, during the bending process. The recessed surface 576 forms a space to allow overbending of the contacts 106.

Figure 12:
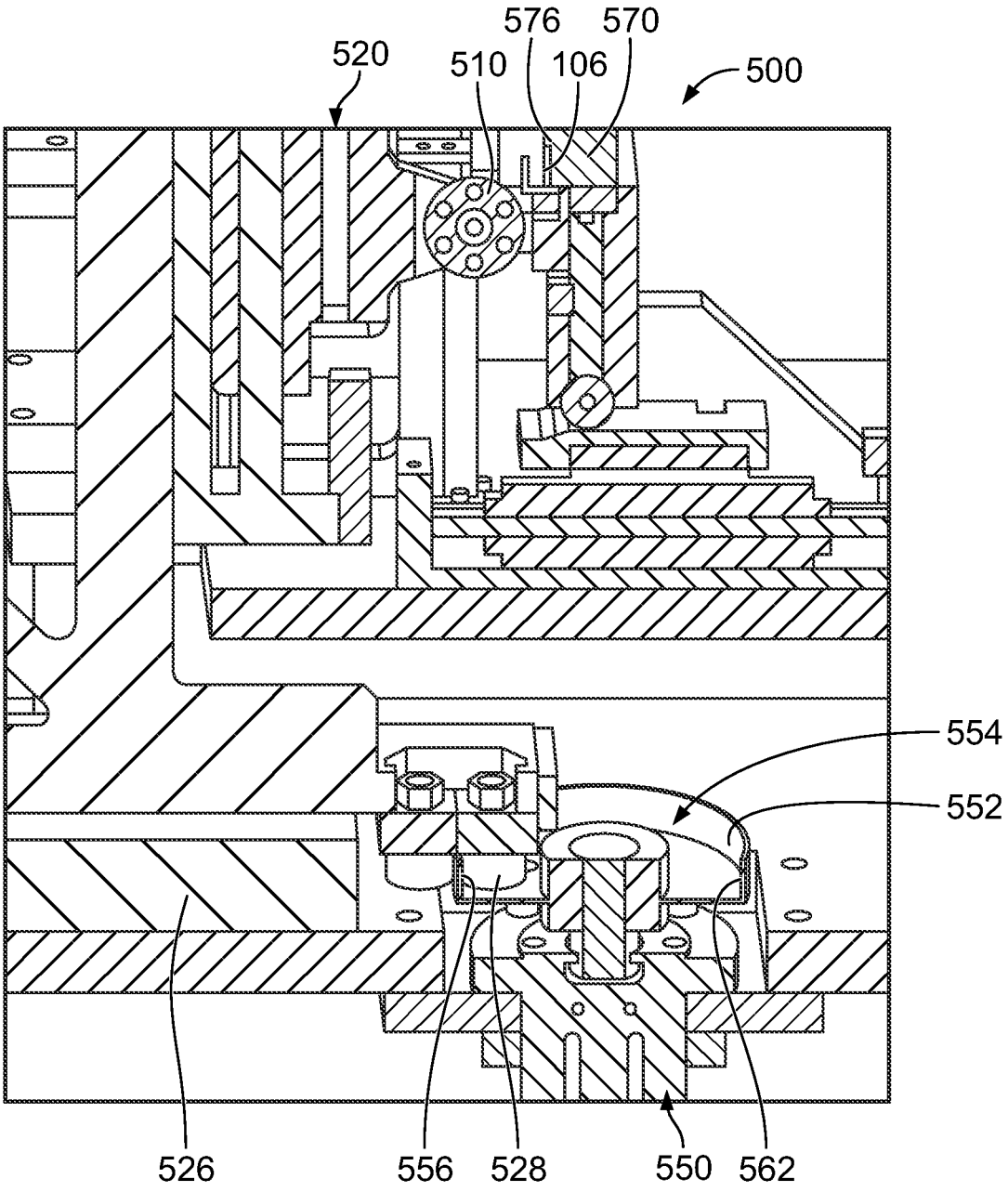
FIG. 12 is a cross-sectional view of a portion of the contact bending assembly in accordance with an exemplary embodiment having some components removed to illustrate internal components of the contact bending assembly.

FIG. 12 is a cross-sectional view of a portion of the contact bending assembly 500 in accordance with an exemplary embodiment having some components removed to illustrate internal components of the contact bending assembly 500. During operation, the roller 510 is advanced by the bending actuator 520 to engage the contacts 106 and bend the ends of the corresponding contacts 106. The roller 510 rolls along the contacts 106 as the roller is advanced by the bending actuator 520. In an exemplary embodiment, the roller 510 is moved in both the actuation direction (vertically) and the lateral shifting direction (horizontally) to overbend the contacts 106. The roller 510 bends the contacts 106 into the space defined by the recessed surface 576 of the forming anvil 570 as the roller 510 is moved in the lateral shifting direction. The amount of lateral shifting may be adjusted, such as by controlling the operation of the lateral actuator 550 (for example, controlling the amount of rotation of the cam device 552) to control the amount of bending and achieve the 90° bend on the contacts 106 after spring back. For example, a user may adjust the amount of lateral shifting in real time as the machine is operated. In an exemplary embodiment, a drive pin 528 extends from the slide 526 into the pocket 554. The drive pin 528 engages the outer wall 562 and rides along the cam surface 556 to laterally shift the position of the slide 526, and thus the bending actuator 520 and the roller 510.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector assembling machine for assembling an electrical connector including a connector housing manufactured from a connector strip that is a continuous extruded dielectric material and contacts manufactured from continuous wires, the electrical connector assembling machine comprising:

a connector strip feed unit including a connector strip feed track receiving the connector strip, the connector strip feed unit including a connector strip feeding device configured to index the connector strip through the connector strip feed track in successive feed strokes;

a contact loading assembly adjacent the connector strip feed track to load contacts in the connector strip, the contact loading assembly including a wire feed unit including feed tracks receiving the wires, the wire feed unit including a feeding device configured to simultaneously index the wires through the corresponding feed tracks in successive feed strokes, the contact loading assembly including a contact forming unit receiving the wires from the wire feed unit, the contact forming unit having a wire cutter for separating the contacts from the wires, the contact loading assembly including a contact loading device loading the contacts made from the wires into the connector strip as the connector strip is advanced through the electrical connector assembling machine; and a contact bending assembly positioned downstream of the contact loading assembly, the contact bending assembly including a roller and a bending actuator holding the roller, the bending actuator moving the roller in an actuation direction to engage and bend ends of the contacts, the roller rolling along the contacts to bend the ends of the contacts.

2. The electrical connector assembling machine of claim 1, wherein the bending actuator moves the roller in a vertical direction between a retracted position and an advanced position, the roller engaging the contacts in the advanced position.

3. The electrical connector assembling machine of claim 1, wherein the contact bending assembly includes a forming anvil having a bending profile, the roller bending the ends of the contacts against the bending profile.

4. The electrical connector assembling machine of claim 3, wherein the forming anvil includes a base, a recessed surface and a bending edge between the base and the recessed surface, the bending edge defining the bending profile.

5. The electrical connector assembling machine of claim 4, wherein the recessed surface is recessed relative to the bending edge to allow overbending of the ends of the contacts beyond a right-angle bend.

6. The electrical connector assembling machine of claim 3, wherein the roller includes an outer surface engaging the contacts, the outer surface being offset from the forming anvil by a distance equal to a thickness of the contact.

7. The electrical connector assembling machine of claim 1, wherein the roller has a width greater than a contact pitch between the contacts to bend multiple contacts simultaneously.

8. The electrical connector assembling machine of claim 1, wherein the bending actuator includes a motor, a ball screw driven by the motor, and a carriage operably coupled to the ball screw, the roller being carried by the carriage and movable with the carriage, wherein the motor is operated to drive the ball screw and move the carriage in a forward direction and a reverse direction to move the roller between a retracted position and an advanced position.

9. The electrical connector assembling machine of claim 1, wherein the contact bending assembly includes a lateral actuator moving the roller in a lateral direction perpendicular to the actuation direction.

10. The electrical connector assembling machine of claim 1, wherein the contact bending assembly includes a cam device for moving the bending actuator and the roller relative to the connector strip in a lateral shifting direction perpendicular to the actuation direction.

11. The electrical connector assembling machine of claim 10, wherein the contact bending assembly includes a slide mounted to a frame of the electrical connector assembling machine, the bending actuator and the roller being mounted to the slide, the cam device operated to move the slide in the lateral shifting direction to shift the roller relative to the contacts.

12. The electrical connector assembling machine of claim 1, wherein the roller is a first roller and the bending actuator is a first bending actuator, the contact bending assembly further comprising a second roller and a second bending actuator holding the second roller, the second bending actuator moving the second roller in an actuation direction to engage and bend ends of the contacts, the second roller rolling along the contacts to bend the corresponding ends of the contacts, wherein the first roller is configured to bend the ends of the contacts in a first direction and the second roller is configured to bend the ends of the contacts in a second direction different than the first direction, wherein the first actuator and the second actuator are selectively operated to move the first roller or the second roller, respectively, to bend the ends of the contacts.

13. The electrical connector assembling machine of claim 1, wherein the roller is a first roller and the bending actuator is a first bending actuator operable to bend front ends of the contacts, the contact bending assembly further comprising a second roller and a second bending actuator holding the second roller, the second bending actuator moving the second roller in an actuation direction to engage and bend rear ends of the contacts, the second roller rolling along the contacts to bend the rear ends of the contacts, wherein the first actuator and the second actuator are selectively operated to move the first roller or the second roller, respectively, to bend the front ends or the rear ends of the contacts, respectively.

14. An electrical connector assembling machine for assembling an electrical connector including a connector housing manufactured from a connector strip that is a continuous extruded dielectric material and contacts manufactured from continuous wires, the electrical connector assembling machine comprising:

a connector strip feed unit including a connector strip feed track receiving the connector strip, the connector strip feed unit including a connector strip feeding device configured to index the connector strip through the connector strip feed track in successive feed strokes;

a contact loading assembly adjacent the connector strip feed track to load contacts in the connector strip, the contact loading assembly including a wire feed unit including feed tracks receiving the wires, the wire feed unit including a feeding device configured to simultaneously index the wires through the corresponding feed tracks in successive feed strokes, the contact loading assembly including a contact forming unit receiving the wires from the wire feed unit, the contact forming unit having a wire cutter for separating the contacts from the wires, the contact loading assembly including a contact loading device loading the contacts made from the wires into the connector strip as the connector strip is advanced through the electrical connector assembling machine; and a contact bending assembly positioned downstream of the contact loading assembly, the contact bending assembly including bending unit for bending ends of the contacts, the bending unit including a roller, a bending actuator holding the roller, and a cam device for moving the bending actuator and the roller relative to the connector strip in a lateral shifting direction, the bending actuator moving the roller to engage and bend the ends of the contacts, the roller rolling along the contacts to bend the ends of the contacts.

15. The electrical connector assembling machine of claim 14, wherein the contact bending assembly includes a slide mounted to a frame of the electrical connector assembling machine, the bending actuator and the roller being mounted to the slide, the cam device operated to move the slide in the lateral shifting direction to shift the roller relative to the contacts.

16. The electrical connector assembling machine of claim 14, wherein the contact bending assembly includes a forming anvil having a bending profile, the roller bending the ends of the contacts against the bending profile.

17. The electrical connector assembling machine of claim 16, wherein the bending profile has a recessed surface recessed relative to a bending edge to allow overbending of the ends of the contacts beyond a right-angle bend.

18. The electrical connector assembling machine of claim 14, wherein the bending actuator includes a motor, a ball screw driven by the motor, and a carriage operably coupled to the ball screw, the roller being carried by the carriage and movable with the carriage, wherein the motor is operated to drive the ball screw and move the carriage in a forward direction and a reverse direction to move the roller between a retracted position and an advanced position.

19. An electrical connector assembling machine for assembling an electrical connector including a connector housing manufactured from a connector strip that is a continuous extruded dielectric material and contacts manufactured from continuous wires, the electrical connector assembling machine comprising:

a connector strip feed unit including a connector strip feed track receiving the connector strip, the connector strip feed unit including a connector strip feeding device configured to index the connector strip through the connector strip feed track in successive feed strokes;

a contact loading assembly adjacent the connector strip feed track to load contacts in the connector strip, the contact loading assembly including a wire feed unit including feed tracks receiving the wires, the wire feed unit including a feeding device configured to simultaneously index the wires through the corresponding feed tracks in successive feed strokes, the contact loading assembly including a contact forming unit receiving the wires from the wire feed unit, the contact forming unit having a wire cutter for separating the contacts from the wires, the contact loading assembly including a contact loading device loading the contacts made from the wires into the connector strip as the connector strip is advanced through the electrical connector assembling machine; and a contact bending assembly positioned downstream of the contact loading assembly, the contact bending assembly including a first bending unit for bending first ends of the contacts, the first bending unit including a first roller and a first bending actuator holding the first roller, the first bending actuator moving the first roller to engage and bend the first ends of the contacts, the contact bending assembly including a second bending unit for bending second ends of the contacts, the second bending unit including a second roller and a second bending actuator holding the second roller, the second bending actuator moving the second roller to engage and bend the second ends of the contacts; wherein the first bending unit and the second bending unit are selectively operated to bend the corresponding first or second ends of the contacts.

20. The electrical connector assembling machine of claim 19, wherein the first roller is configured to bend the first ends of the contacts in a first direction and the second roller is configured to bend the second ends of the contacts in a second direction different than the first direction.

21. The electrical connector assembling machine of claim 19, wherein the first ends of the contacts are front ends of the contacts, the first bending unit located forward of the connector strip and the contacts, the second ends of the contacts are rear ends of the contacts, the second bending unit located rearward of the connector strip and the contacts.

* * * * *